United States Patent [19]

Pascual

[11] Patent Number: 4,493,154

[45] Date of Patent: Jan. 15, 1985

[54] TAPER GAUGE DEVICE FOR HAIR CLIPPERS

[76] Inventor: Gabriel E. Pascual, 1111 Bishop St., Room 1, Honolulu, Hi. 96813

[21] Appl. No.: 389,944

[22] Filed: Jun. 18, 1982

[51] Int. Cl.[3] ..... B26B 19/38

[52] U.S. Cl. ..... 33/185 R; 30/233.5

[58] Field of Search ..... 33/180 R, 185 R, 186, 33/181 R; 30/233, 233.5, 286

[56] References Cited

U.S. PATENT DOCUMENTS

| | | | |
|---|---|---|---|
| 2,809,425 | 10/1957 | Tettis | 30/233.5 |
| 2,826,812 | 3/1958 | Haislip | 30/233.5 X |
| 3,651,570 | 3/1972 | Groves | 30/233 |

FOREIGN PATENT DOCUMENTS

| | | | |
|---|---|---|---|
| 2440748 | 3/1976 | Fed. Rep. of Germany | 30/233.5 |
| 52-29351 | 3/1977 | Japan | 30/233.5 |
| 54-97151 | 8/1979 | Japan | 30/233.5 |

*Primary Examiner*—William D. Martin, Jr.

[57] ABSTRACT

This taper gauge device is for barbers, stylists, beauticians, and the layman, and primarily, it consists of a body which is received on the cutting head of a hair clipper. It also includes teeth on its side walls and spaced ribs, for rolling movement on a person's hair, and openings are included in its side walls for receiving a pair of pins extending from the head of the hair clipper.

5 Claims, 4 Drawing Figures

19
23
10
23
22
13
12
20
25
15
16
14
20
27
26
28a
29
11
17

34
35
35

12
16
20
27
26
29
16
33
36
10

23
12

22
25
20
13
20
4
14
19
31
11
22
18
25
20
29
20
24
30
18
26
29
17
4
21

20a
13
16
22a
14
12a
15
31
32
28a
30
26
17
18
29
28

TAPER GAUGE DEVICE FOR HAIR CLIPPERS

This invention relates to hair cutting instruments, and more particularly, to a taper gauge device for hair clippers.

The principal object of this invention is to provide a taper gauge device for hair clippers, which will be employed by barbers, stylists and beauticians, for cutting hair at the rear of a customer's head within a minimum amount of time, as compared with the method of the prior art. Another object of this invention is to provide a taper gauge device for hair clippers, which may also be used by the layman, as well as by the skilled professionals, because its use will require only minimal skill.

A further object of this invention is to provide a taper gauge device for hair clippers, which will be removably attached to an electric hair clipper.

Other objects are to provide a Taper Gauge Device for Hair Clippers, which is simple in design, inexpensive to manufacturer, rugged in construction, easy to use, and efficient in operation.

These, and other objects, will be readily evident, upon a study of the following specification, and the accompanying drawing, wherein.

Figure 1:
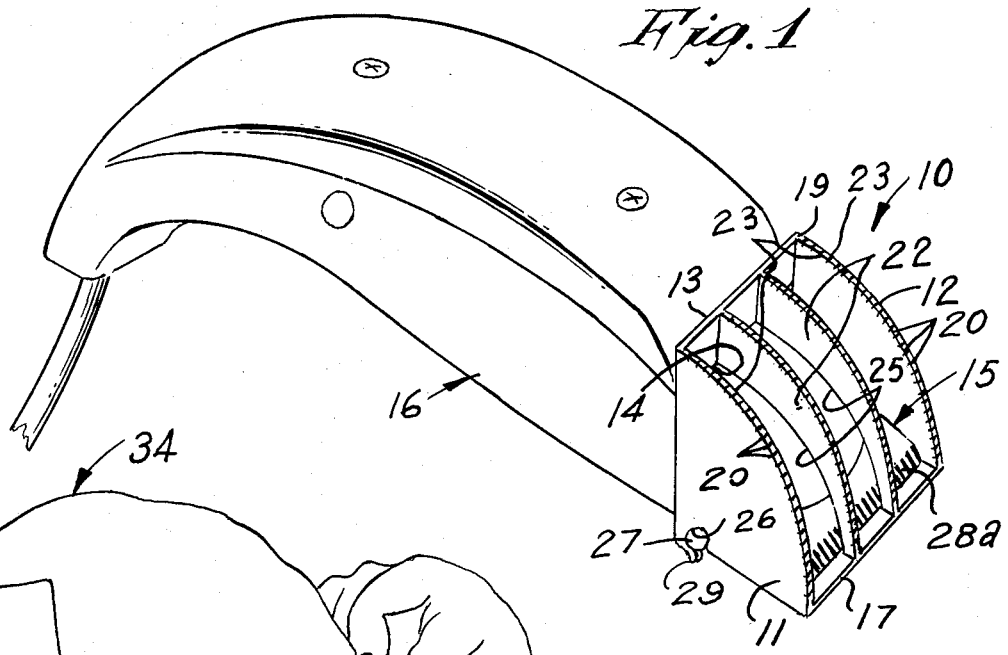
FIG. 1 is a perspective view of the present invention, shown secured to an electric hair clipper.

According to this invention, a device 10 is shown to include a pair of parallel spaced-apart side walls 11 and 12, which are fixedly secured to a rear wall 13 in a suitable manner, which defines an opening 14 for removably receiving the head 15 of hair clipper 16. A bottom wall 17 is fixedly secured to and between side walls 11 and 12 in a suitable manner, and defines an opening 18 in the bottom of device 10. Side walls 11 and 12 include an arcuate edge 19, having a plurality of teeth 20, which extend to a non-toothed portion 21, and a pair of arcuate rib members 22 are equally spaced between side walls 11 and 12, and are also provided with teeth 20 on their exterior arcuate edges 23, which extend to a non-toothed portion 24. The arcuate bottom edges 25 of rib members 22 serve as a trim line guide for hair, when it is being cut by the aid of device 10, and a circular cut-out 26, in the corner portions of each of the side walls 11 and 12, provide a means of removably receiving a flat headed pin 27, which is fixedly secured to each side of the lower hair clipper blade 28 by suitable means. A downward extending and arcuate lip 29 is integrably attached to edge 30 of each of the side walls 11 and 12, and provides hook means, so as to guide the pins 27 quickly into the cut-outs 26, which will hold device 10 to the clipper 16. Bottom wall 17 also includes an inclined surface 31, for engaging the forward lip end 32 of lower blade 28, so as to render blade 28 stationary when it is in position within device 10.

It shall be noted, that device 10 may be modified to have rib members 22 with a different arcuate curve on their bottom edges 25.

Figure 2:
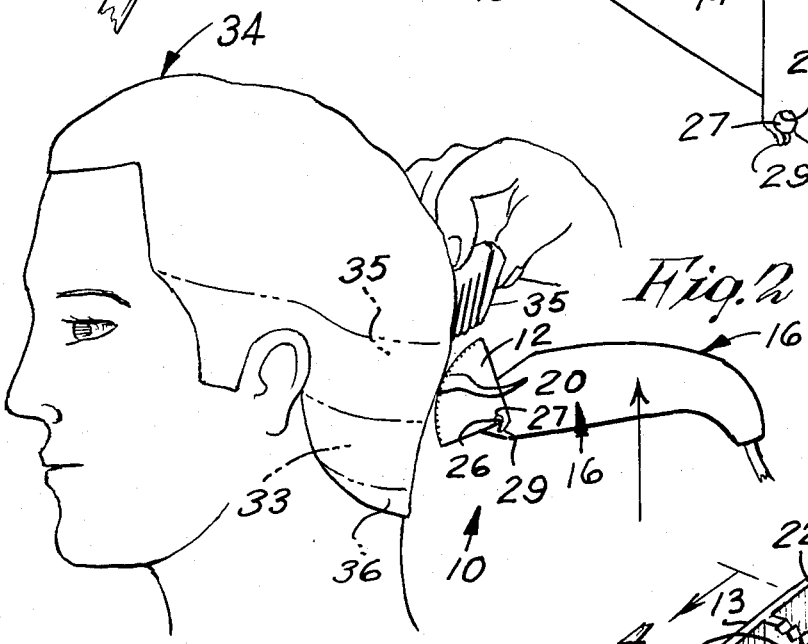
FIG. 2 is a side view of FIG. 1, shown in operative use.
Figure 3:
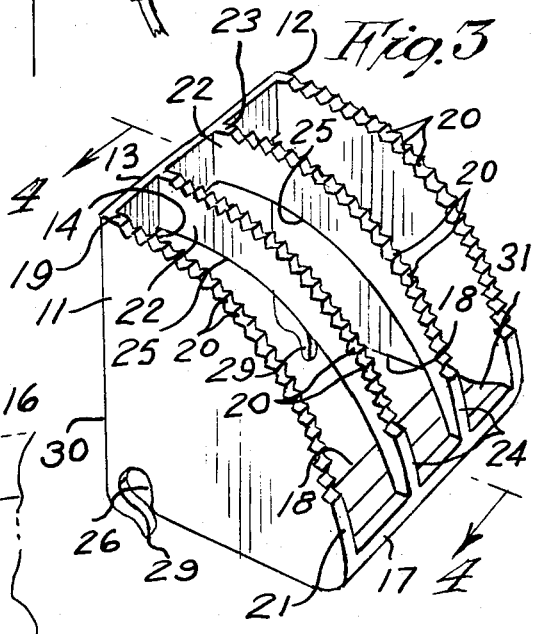
FIG. 3 is an enlarged perspective view of the invention, shown removed from the clipper.

In use, the head 15 of clipper 16 is positioned below device 10, and its side pins 27 are snapped into the cut-outs 26, and the lip end 32 of lower blade 28 is pivoted to engagement with surface 31 of bottom wall 17. When it is desired to taper area 33 of the customer's head 34, and the clipper 16 is in place, the comb 35 is positioned in front of device 10, and the clipper 16 is moved in an upward motion, as indicated by the arrow 16 in FIG. 2. By rolling the clipper 16 with the teeth 20 of rib members 22, and walls 11 and 12 in engagement with the hair, the hair will fall into the blades **28*a* and 28 at a graduated elevation. After the above-mentioned cutting, a modified device 10, with different concaved rib members 22, will be used in the same manner to cut the taper area 35. When the above-mentioned is accomplished, the device 10 is removed from the clipper 16, by disengaging the pins 27 from the cut-outs 26, and the clipper blades 28 and 28*a*** are used only for finishing.

Figure 4:
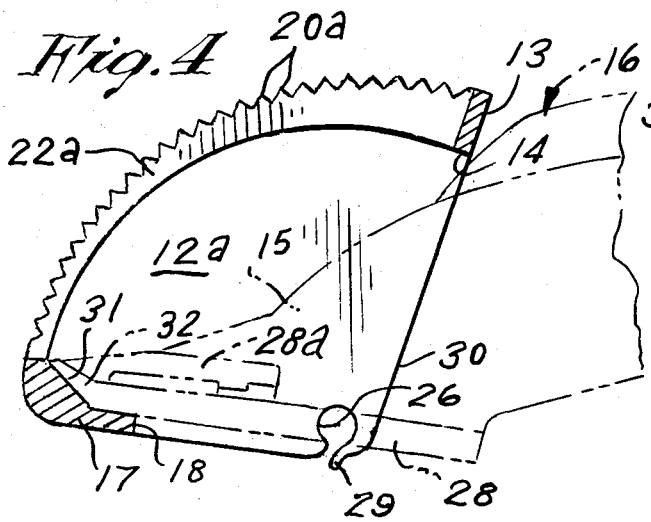
FIG. 4 is a further enlarged cross-sectional view, taken along the line 4—4 of FIG. 3, which shows the hair clipper fragmentary and in phantom lines, and illustrates a modified tooth arrangement.

Referring now to FIG. 4 of the drawing, the structure of device 10 is the same, except that the modified side walls **12*a*, and the modified rib members 22*a*, include teeth 20*a***, which extend from end to end thereof.

In use, the side walls **12*a* and the rib members 20*a* function in the same manner as was heretofore described of walls 11, 12, and the rib members 22, with the exception, that full rolling of clipper 16 may be easily accomplished, because there is greater linear tooth area, since the teeth 20*a*** extend from end to end.

While various changes may be made in the detail construction, it is understood that such changes will be within the spirit and scope of the present invention, as is defined by the appended claims.

What I now claim is:

1. A device for causing hair clippers to make a tapered cut, comprising a member adapted for operative attachment to a comb-type power driven hair clipper, said member having a curved surface engageable with the hair at the back of a human head for rolling movement upwardly from the neck, and means formed for effecting a pivotal mounting of said member on said hair clipper with said curved surface extending beyond the cutting end of said hair clipper, said curved surface being eccentric with respect to the axis of said pivotal mounting whereby pivoting of said member on said hair clipper as said curved surface is rolled upwardly against the back of the head causes the forward end of said clipper to move gradually further away from said head and thus increase the length of the hairs being cut.

2. A device as described in claim 1, and wherein said member is formed with a plurality of spaced walls, with the outer edges of said walls provides said curved surface.

3. A device as described in claim 2 and wherein said curved surface is serrated to avoid slippage as said curved surface is rolled upwardly against the back of said head.

4. A device as described in claim 1 and wherein said member is formed with side walls providing said curved surface, and a rib is positioned intermediate said side walls and also providing said curved surface.

5. A device as described in claim 4 and wherein said rib has an inner curved surface concentric with the axis of pivotal mounting and just clearing the cutting end of said hair clipper at all relative positions of said member and said hair clipper.

* * * * *